US011466230B1

(12) United States Patent
Li et al.

(10) Patent No.: US 11,466,230 B1
(45) Date of Patent: Oct. 11, 2022

(54) REMOVING ORGANIC CHLORIDES FROM GLYCERIDE OILS

(71) Applicant: CHEVRON U.S.A. INC., San Ramon, CA (US)

(72) Inventors: Lin Li, San Ramon, CA (US); Michelle K. Young, Manvel, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 17/326,028

(22) Filed: May 20, 2021

(51) Int. Cl.
*C11B 3/06* (2006.01)
*C10G 3/00* (2006.01)

(52) U.S. Cl.
CPC . *C11B 3/06* (2013.01); *C10G 3/42* (2013.01)

(58) Field of Classification Search
CPC ..... C11B 3/06; C10G 3/42
See application file for complete search history.

(56) References Cited

U.S. PATENT DOCUMENTS

| | | | | |
|---|---|---|---|---|
| 9,051,260 | B2 | 6/2015 | Rongione et al. | |
| 10,221,374 | B2 | 3/2019 | Fedor et al. | |
| 10,316,268 | B2 | 6/2019 | Goodrich et al. | |
| 2004/0055209 | A1* | 3/2004 | Jakkula | C10G 3/50 44/302 |
| 2012/0209017 | A1 | 8/2012 | Ouni et al. | |
| 2012/0238770 | A1 | 9/2012 | Bloomer et al. | |
| 2015/0166930 | A1 | 6/2015 | Hed et al. | |
| 2018/0134987 | A1* | 5/2018 | Fedor | C11B 3/12 |

FOREIGN PATENT DOCUMENTS

| | | | |
|---|---|---|---|
| CN | 105368580 | A | 3/2016 |
| WO | 2019139533 | A1 | 7/2019 |

OTHER PUBLICATIONS

A. Ermacora and K. Hrncirik "Study on the thermal degradation of 3-MCPD esters in model systems simulating deodorization of vegetable oils" Food Chem. 2014, 150, 158-163.

PCT International Search Report, International Appl. No. PCT/IB2022/053453, dated Jun. 6, 2022.

* cited by examiner

*Primary Examiner* — Ellen M McAvoy
*Assistant Examiner* — Chantel L Graham

(57) ABSTRACT

A process is provided for removing organic chlorides from glyceride oil. The process includes the steps of (a) reacting a glyceride oil comprising organic chlorides with a liquid aqueous system at a temperature of at least 80° C. to form a treated glyceride oil and (b) separating the treated glyceride oil from the liquid aqueous system. The treated glyceride oil has a reduced concentration of organic chlorides compared to the glyceride oil reacted in step (a).

7 Claims, No Drawings

REMOVING ORGANIC CHLORIDES FROM GLYCERIDE OILS

FIELD

The present disclosure relates to processes for purifying glyceride oils. The glyceride oil is subjected to purification where impurities are removed. The purified glyceride oil may be used in the manufacture of products comprising hydrocarbons, suitable as fuels or fuel components. The purified glyceride oil is suitable as a feed for biofuel production.

BACKGROUND

There is an increasing interest in alternative feedstocks for replacing at least partly crude oil, in the production of hydrocarbons, suitable as fuels or fuel components, for example as transportation fuels, or compatible with fuels. Biofuels are typically manufactured from feedstock originating from renewable sources including oils and fats obtained from plants, animals, algal materials, fish, and various waste streams, side streams and sewage sludge. These feedstocks, particularly the various waste streams and side streams, contain varying amounts of contaminants, such as organic chloride compounds which are, for example, deleterious to converting catalysts.

Despite the ongoing research and development in the processing of renewable feedstocks and manufacture of fuels, there is still a need to provide an improved process for purifying renewable glyceride oil feedstock to provide purified feedstock, which is suitable for converting to valuable chemicals, such as hydrocarbons suitable as fuels or fuel blending components.

SUMMARY

In a first aspect, there is provided a process for removing organic chlorides from a glyceride oil, the process comprising the steps of: (a) reacting a glyceride oil comprising organic chlorides with a liquid aqueous system at a temperature of at least 80° C. to form a treated glyceride oil; and (b) separating the treated glyceride oil from the liquid aqueous system; wherein the treated glyceride oil has a reduced concentration of organic chlorides compared to the glyceride oil reacted in step (a).

In second aspect, there is provided a process for removing organic chlorides from a glyceride oil, the process comprising the steps of: (a) heating a glyceride oil comprising organic chlorides at a temperature of at least 80° C. to form a treated glyceride oil, wherein the glyceride oil has a water content of from 0.05 to 1.0 wt. %; and (b) separating the treated glyceride oil from the water; wherein the treated glyceride oil has a reduced concentration of organic chlorides compared to the glyceride oil heated in step (a), and wherein the process is conducted in the absence of an externally added liquid aqueous solvent system.

In a third aspect, there is provided a process for removing organic chlorides from a glyceride oil, the process comprising the steps of: (a) heating a glyceride oil comprising organic chlorides at a temperature of at least 80° C. to form a treated glyceride oil, wherein the glyceride oil has a water content of from 0.05 to 1.0 wt. %; (b) washing the treated glyceride oil with water, thereby generating an aqueous phase comprising water and chloride compounds and a non-aqueous phase comprising the treated glyceride oil, wherein the treated glyceride oil has a reduced concentration of organic chlorides compared to the glyceride oil heated in step (a); and (c) separating the non-aqueous phase from the aqueous phase.

DETAILED DESCRIPTION

The term "glyceride oil" used herein refers to an oil or fat which comprises triglycerides as the major component thereof. For example, the triglyceride component may be at least 50 wt. % of the glyceride oil. The glyceride oil may also include mono- and/or di-glycerides.

The term "organic chloride" denotes a compound of the general formula R—Cl wherein R is an organic group comprising at least one carbon atom directly bonded to Cl, that may contain one or more heteroatoms like hydrogen, oxygen, nitrogen, sulfur, phosphorus, fluorine, chlorine, bromine, or iodine.

The term "thermal treatment" as used herein encompasses warming or heating and/or keeping a material at an elevated temperature, i.e., a temperature above room temperature (21° C.).

The term "ppm" means parts-per-million and is a weight relative parameter. A part-per-million is a microgram per gram, such that a component that is present at 100 ppm is present at 100 micrograms of the specific component per 1 gram of the aggregate mixture.

The term "weight percent", "wt. %", "percent by weight", "% by weight", and variations thereof refer to the concentration of a substance as the weight of that substance divided by the total weight of the composition and multiplied by 100.

Glyceride oils treated as described herein have reduced amounts of organic chloride. The processes described herein can provide improved chloride reduction even in glyceride oils that have previously undergone conventional pretreatment processes, such as acid washing, base neutralization, filtration through diatomaceous earth, silica, and/or other absorbents, and/or centrifugation.

Suitable glyceride oils include animal fats, animal oils, plant fats, plant oils, vegetable fats, vegetable oils, greases, used cooking oil, algae oils, or any combination thereof.

Plant and/or vegetable oils may include babassu oil, camelina oil, canola oil, carinata oil, castor oil, coconut oil, inedible corn oil, jatropha oil, palm oil, palm oil fatty acid distillate, palm kern oil, palm sludge oil, rapeseed oil, soybean oil, sunflower oil, tall oil, tall oil fatty acid, and any combination thereof. These may be classified as crude, degummed, and RBD (refined, bleached, and deodorized) grade, depending on level of pretreatment and residual phosphorus and metals content. However, any of these grades may be used herein.

Animal fats and/or oils may include inedible tallow, edible tallow, technical tallow, floatation tallow, lard, poultry fat (e.g., chicken fat), poultry oils, fish fat, fish oils, and mixtures thereof.

Greases may include yellow grease, brown grease, used cooking oil, waste vegetable oils, restaurant greases, trap grease from municipalities such as water treatment facilities, spent oils from industrial packaged food operations, and any combination thereof.

Algal sources for algal oils include prokaryotic autotrophic algae and eukaryotic algae, microalgae as well as multicellular algae and macroalgae from marine, brackish water, freshwater, or other aqueous sources such as aqueous medium in an algae culture system. The most common oil-producing algae can generally include the diatoms (bacillariophytes), green algae (chlorophytes), blue-green algae (cyanophytes), and golden-brown algae (chrysophytes). In addition, a fifth group known as haptophytes may be used. Groups include brown algae and heterokonts. Specific examples of algae include the classes: Chlorophyceae, Eustigmatophyceae, Prymnesiophyceae, Bacillariophyceae. Bacillariophytes capable of oil production include the genera *Amphipleura, Amphora, Chaetoceros, Cyclotella, Cymbello, Fragilaria, Hantzchia, Navicula, Nitzschia, Phaeodactylum*, and *Thalassiosira*. Chlorophytes capable of oil production include *Ankistrodesmus, Botryococtus, Chlorella, Chlorococcum, Dunaliella, Monoraphidium, Oocystis, Scenedesmus*, and *Tetraselmis*, Ire one aspect, the chlorophytes can be *Chlorella* or *Dunaliella*. Cyanophytes capable of oil production include *Oscillatoria* and *Synechococcus*. Chrysophytes capable of oil production includes *Boekelovia*. Specific examples of haptophytes include *Isochysis* and *Pleurochysis*.

In some aspects, the glyceride oil may include yellow grease, brown grease, floatation grease, poultry fat, inedible corn oil, used cooking oil, inedible tallow, floatation tallow, palm sludge oil, or any combination thereof.

The glyceride oil may have an organic chloride content of at least 0.01 ppm (e.g., at least 0.5 ppm, at least 1.0 ppm, 0.01 ppm to 100 ppm, 0.01 ppm to 25 ppm, 0.5 ppm to 100 ppm, 0.5 to 25 ppm, 1 ppm to 100 ppm, or 1 ppm to 25 ppm) measured as elemental chlorine (a CI atom).

The glyceride oil may suitably further comprise water dissolved therein. For example, the glyceride oil may suitably comprise water in an amount equal to or more than 0.01 wt. % (e.g., equal to or more than 0.05 wt. %, or equal to or more than 0.10 wt. %) and equal to or less than 1.0 wt. % (e.g., equal to or less than 0.75 wt. %, equal to or less than 0.50 wt. %, or equal to or less than 0.25 wt. % water), based on the total weight of the glyceride oil. Water content can be measured by ASTM E203.

Any conceivable amount of water can be contained in the liquid aqueous system, provided that the water content of the liquid aqueous system is greater than 75 wt. %. Generally, the amount of water contained in the liquid aqueous system is at least 85 wt. % (e.g., at least 90 wt. %, at least 95 wt. %, at least 99 wt. %, or at least 99.9 wt. %). The liquid aqueous system may essentially consist of water. The water used in the process, as such and in the liquid aqueous system is suitably de-aerated and demineralized or softened prior to introducing to the process. The liquid aqueous system may comprise water soluble and/or water miscible organic compounds. The water soluble and/or water miscible organic compounds may be water soluble alcohols, phenols, aldehydes, ketones, etc.

When the glyceride oil has a sufficient dissolved water content, (e.g., 0.05 to 1.0 wt. %, 0.05 to 0.50 wt. % 0.10 to 1.0 wt. %, 0.10 to 0.50 wt. %), the glyceride oil may be heated in the absence of an externally added liquid aqueous system to provide a treated glyceride oil. After treatment, water may be separated from the treated glyceride oil using the techniques described herein below.

The liquid aqueous solvent system may further comprise a base. The base can be a liquid-phase, homogeneous catalyst or can be supported on a solid carrier to provide a heterogeneous catalyst.

Suitable bases for homogeneous catalysis include alkali metal hydroxides, carbonates, and alkoxides. Representative examples include sodium hydroxide, potassium hydroxide, sodium bicarbonate, sodium carbonate, potassium carbonate, and sodium methoxide. Additionally or alternatively, the base may be ammonia or ammonium hydroxide.

Suitable bases for heterogeneous catalysis include caustic ion-exchange resins (e.g., AMBERLYST® A26); metal oxides (e.g., CaO, MgO, $La_2O_3$, ZnO, ZnO—$Al_2O_3$); alkaline earth alkoxides (e.g., $Ca(OCH_3)_2$); basic clays (e.g., hydrotalcite, chrysolite and sepiolite); magnesium silicates generally derived from the interaction of a magnesium salt and soluble silicate; zeolites exchanged with strongly basic metal cations (e.g., K, Cs) or containing other occluded basic species, such as Cs—X; supported alkaline metal compounds such as alkali metal compounds on silica or alumina (e.g., $Na_2O/SiO_2$, $Na_2O/Al_2O_3$) and alkali metal compounds on alkaline earth oxides (e.g., $Na_2O/MgO$); and organic bases grafted on a support (e.g., guanidines, salts of amino acids containing guanidino or quaternary ammonium groups immobilized on a polymeric support material).

The amounts for homogeneous catalysts may be different from the amounts of heterogeneous catalysts.

The pH of the liquid aqueous system may be a range of from 7 to 12 (e.g., greater than 7 to 12, 8 to 12, or 8 to 10). The pH of the liquid aqueous system is determined using a pH sensitive glass electrode.

Suitably, the reacting step (a) of the process is carried out a temperature of greater than 80° C. (e.g., 100° C. to 300° C., or 150° C. to 275° C.). As will be appreciated, where the glyceride oil is a solid or semi-solid at room temperature, higher temperatures are preferable such that the glyceride oil is in a liquid form for contacting with the liquid aqueous system. The reacting step (a) may be carried out at a pressure of from 100 kPa to 10 MPa.

The glyceride oil and the liquid aqueous system may be reacted in a glyceride to aqueous mass ratio of from 1:2 to 100:1 (e.g., 1:1 to 50:1, 1:1 to 25:1, 1:1 to 10:1, or 1.5:1 to 5:1).

The reacting step may be carried out for a time of from 0.1 minute to 12 hours (e.g., 5 minutes to 12 hours, 5 minutes to 5 hours, 10 minutes to 12 hours, 10 minutes to 12 hours, 15 minutes to 12 hours, or 15 minutes to 5 hours).

The reacting step may be carried out by contacting glyceride oil with the liquid aqueous system in a vessel wherein the resulting mixture is stirred using, for example, a mechanical stirrer, an ultrasonic stirrer, an electromagnetic stirrer or by bubbling an inert gas through the mixture. Alternatively, the reacting step may be carried out by passing a mixture of the glyceride oil and the liquid through a static mixer, such as a Sulzer mixer or a Kenics mixer.

Separation of the treated glyceride oil from the liquid aqueous system may be carried out by gravity separation (for example, in a settling unit), where the treated glyceride oil is generally the upper phase and liquid aqueous system in the lower phase in the settling unit. Separation may also be achieved using, for example, a decanter, a hydrocyclone, a coalescer, a centrifuge or a membrane filter press. In some aspects, the phases are separated using a centrifuge. Reacting and separating steps may be repeated several times (e.g., 2-4 times).

Where a heterogeneous base is used, the reacting and separating steps may be carried out together by passing the glyceride oil through a column packed with a heterogeneous base (i.e., a packed bed arrangement). Additionally or alternatively, a fixed-bed arrangement having a plurality of plates and/or trays may be used. Slurry reactors may also be used.

The process reacting and separating steps may be carried out as a batch process or a continuous process.

The process can be operated to avoid hydrolysis of acylglycerols in the glyceride oil to glycerol as a by-product. Any glycerol formed as by-product can be removed with the aqueous phase comprising impurities.

The glyceride oil feedstock may be subjected to at least one refining step before and/or after, preferably before, thermal treatment. The at least one refining step may include refining steps selected from degumming, bleaching, hydrolysis, soap stock splitting, deacidification, alkali neutralization, cold neutralization, micella refining, and deodorization.

The treated glyceride oil can have a total concentration of organic chlorides which is at least 50% (e.g., at least 75%, at least 90%, or at least 95%) lower than that of the glyceride oil feed.

In some aspects, a process is provided for removing organic chlorides from a glyceride oil which comprises the steps of: (a) heating a glyceride oil comprising organic chlorides at a temperature of at least 80° C. to form a treated glyceride oil, wherein the glyceride oil has a water content of from 0.05 to 1.0 wt. %; (b) washing the treated glyceride oil with water, thereby generating an aqueous phase comprising water and chloride compounds and a non-aqueous phase comprising the treated glyceride oil, wherein the treated glyceride oil has a reduced concentration of organic chlorides compared to the glyceride oil heated in step (a); and (c) separating the non-aqueous phase from the aqueous phase.

Water used for the water wash may be tap water, distilled water, deionized water, purified water or sterilized water. Suitably distilled water or deionized water is used.

Suitable weight ratios of wash water to treated glyceride oil can range from about 1:2 to about 100:1 (e.g., 1:1 to 50:1, 1:1 to 25:1, 1:1 to 10:1, or 1.5:1 to 5:1).

Suitable effective temperatures for the water wash range from about 20° C. (or alternatively about ambient) to 80° C. (e.g., 20° C. to 60° C.).

While pressures other than ambient pressure (e.g., 90 to 110 kPa) may be employed for the water wash, ambient pressure is desired for reasons of convenience.

The amount of time for exposing the treated glyceride oil to the water wash can vary. Suitable effective times can range from about 1 minute to about 20 minutes (e.g., 2 minutes to 10 minutes).

The washing may be carried out in a stirred vessel or in another conventional apparatus, for example in a column or mixer-settler apparatus.

The treated glyceride oil may be washed 1 to 5 times (e.g., 2 to 3 times) with water after thermal treatment to remove chloride compounds.

The treated glyceride oil can then be separated from the water by any suitable method, such as physical separation (e.g., centrifugation, gravity settling).

Optional Hydroprocessing Step

The treated glyceride oil, having low content of organic chloride compounds, is particularly suitable as feedstock for catalytic hydroprocessing, where equipment fouling and catalyst poisoning and inactivation can be avoided.

The treated glyceride oil may be subjected to a catalytic hydroprocessing step to a hydroprocessed product. The obtained hydroprocessed product or at least one effluent from the hydroprocessing may be fractionated in a fractionating step to provide at least a gaseous stream or fraction, a light hydrocarbon stream or fraction (e.g., C4 to C20) and a heavy hydrocarbon stream or fraction (e.g., C20+).

The treated glyceride oil can be hydroprocessed either as dedicated feed or as a co-feed with a non-renewable feedstock (i.e., fossil feedstock) originating from mineral oil, shale oil or coal.

The catalytic hydroprocessing step may be carried out in one step, or in more than one steps.

The catalytic hydroprocessing comprises at least a hydrodeoxygenation step. Catalytic hydroprocessing may also comprise a hydrodeoxygenation step followed by one or more steps selected from isomerization, hydrodewaxing, hydrodearomatization and hydrocracking steps to provide liquid fuels and other chemicals. Also, gasoline fractions may also be produced that can be used as a bio-naphtha component or as raw material for bio-plastics.

Hydroprocessing may be performed using one or more hydroprocessing catalysts comprising one or more metals selected from Group VIA and Group VIII metals. Particularly useful metals include Mo, W, Co, Ni, Pt and Pd. The catalyst(s) can also contain one or more support materials, for example, zeolite, alumina, gamma-alumina, zeolite-alumina, alumina-silica, zirconia, alumina-silica-zeolite and activated carbon. Suitably a mixture of CoO and $MoO_3$ (CoMo) and/or a mixture of NiO and $MoO_3$ (NiMo), and/or a mixture of Ni, Mo and Co and/or NiW and one or more support materials selected from zeolite, alumina, silica, zeolite-alumina, alumina-silica, alumina-silica-zeolite and activated carbon. Also, noble metals, such as Pt and/or Pd dispersed on gamma-alumina may be used.

The hydroprocessing may be carried out at a pressure (total pressure, abs) of from 500 kPa to 30 MPa (e.g., 3 MPa to 25 MPa or 3 MPa to 12 MPa).

The hydrogen partial pressure may be maintained in a range of from 5 MPa to 25 MPa (e.g., 8 MPa to 20 MPa, or 8 MPa to 11 MPa).

The hydroprocessing may be carried out at a temperature of from 200° C. to 450° C. (e.g., 280° C. to 450° C., or 350° C. to 400° C.).

The hydroprocessing feed rate WHSV (weight hourly space velocity) of the feedstock oil is proportional to an amount of the catalyst. The WHSV of the feed material can be in a range of from 0.1 $h^{-1}$ to 10 $h^{-1}$ (e.g., 0.1 $h^{-1}$ to 5 $h^{-1}$).

The ratio of $H_2$/feed can be in a range of from 600 $Nm^3/m^3$ to 4000 $Nm^3/m^3$ (e.g., 1300 $Nm^3/m^3$ to 2200 $Nm^3/m^3$).

The feed is pumped to a hydroprocessing reactor at a desired speed. The feed rate LHSV (liquid hourly space velocity) of the feed material can be in a range of from 0.01 $h^{-1}$ to 10 $h^{-1}$ (e.g., 0.1 $h^{-1}$ to 5 $h^{-1}$).

The hydroprocessed product may be converted further via one or more hydrocarbon conversion processes into one or more fuel components and/or one or more chemical components.

The one or more hydrocarbon conversion processes may include a fluid catalytic cracking process, a thermal cracking process a hydrocracking process, a hydroisomerization process, a hydrodesulfurization process, or any combination thereof.

The reaction product or part thereof of any of the hydrocarbon conversion processes can subsequently be fractionated to produce one or more product fractions, for example a product fraction boiling in the gasoline range (e.g., from about 35° C. to about 210° C.); a product fraction boiling in the diesel range (e.g., from about 210° C. to about 370° C.); a heavy product fraction boiling above about 370° C.

Any one or more product fractions obtained by fractionation may or may not be further hydrotreated or hydroisomerized to obtain a hydrotreated or hydroisomerized product fraction.

The optionally hydrotreated or hydroisomerized product fraction(s) may be used as biofuel and/or biochemical component(s).

In a preferred embodiment the, optionally hydrotreated or hydroisomerized, one or more product fractions produced in the fractionation can be blended as a biofuel component and/or a biochemical component with one or more other components to produce a biofuel and/or a biochemical. The terms "biofuel" and "biochemical" are herein understood respectively as a fuel or a chemical that is at least party derived from a renewable energy source.

EXAMPLES

The following illustrative examples are intended to be non-limiting.

Chloride content of samples was determined by X-ray fluorescence on a XOS Clora bench-top analyzer (X-ray Optical Systems, Inc., East Greenbush, N.Y.).

Examples 1-3

Treatment of Used Cooking Oil with Water 40 g of used cooking oil and 20 g of deionized water were loaded into a 100 mL autoclave reactor. The headspace inside the autoclave reactor was purged with $N_2$ to remove air, and then sealed. The reactor temperature was increased to 250° C. and held at 250° C. for 4 hours. The fluids inside the reactor were stirred at 500 rpm to maintain good mixing. After reaction, the reactor was cooled down to room temperature. The treated oil was separated from the water by centrifugation and the treated oil was analyzed for chloride content. Additional runs were conducted at 250° C. and 200° C., respectively, each for 0.5 hours. The results are shown in Table 1.

TABLE 1

| | Example 1 | Example 2 | Example 3 |
|---|---|---|---|
| Reaction Time [h] | 4 | 0.5 | 0.5 |
| Temperature [° C.] | 250 | 250 | 200 |
| Cl in Feed Oil [ppm] | 12.4 | 12.4 | 12.4 |
| Cl in Treated Oil [ppm] | 1.31 | 1.38 | 1.8 |

Examples 4-7

Treatment of Used Cooking Oil with NaOH

Example 1 was repeated except that the deionized water was spiked with 100 ppm NaOH. This run was repeated, and additional runs were conducted at 200° C. and 175° C., respectively, each for 0.5 hours. The results are shown in Table 2.

TABLE 2

| | Example 4 | Example 5 | Example 6 | Example 7 |
|---|---|---|---|---|
| Reaction Time [h] | 4 | 4 | 0.5 | 0.5 |
| Temperature [° C.] | 250 | 250 | 200 | 175 |
| Cl in Feed Oil [ppm] | 12.4 | 12.4 | 12.4 | 12.4 |
| Cl in Treated Oil [ppm] | 1.34 | 0.91 | 1.36 | 2.46 |

Examples 8-10

Treatment of Used Cooking Oil with Basic Ion Exchange Resin 40 g of used cooking oil, 20 g of deionized water, and 2 g of a basic ion-exchange resin (AMBERLYST® A26 OH, DuPont) were loaded into a 100 mL autoclave reactor. The headspace inside the autoclave reactor was purged with $N_2$ to remove air, and then sealed. The reactor temperature was increased to 200° C. and held at 200° C. for 0.5 hours. The fluids inside the reactor were stirred at 500 rpm to maintain good mixing. After reaction, the reactor was cooled down to room temperature. The treated oil was separated from the water by centrifugation and the treated oil was analyzed for chloride content. Additional runs were conducted at 175° C. and 200° C. for 0.5 hours and 0.25 hours, respectively. The results are shown in Table 3.

TABLE 3

| | Example 8 | Example 9 | Example 10 |
|---|---|---|---|
| Reaction Time [h] | 0.5 | 0.5 | 0.25 |
| Temperature [° C.] | 200 | 175 | 200 |
| Cl in Feed Oil [ppm] | 12.4 | 12.4 | 12.4 |
| Cl in Treated Oil [ppm] | 0.91 | 2.13 | 1.03 |

Examples 11-12

Treatment of Used Cooking Oil with Magnesium Silicate

Examples 8-9 were repeated except that a basic magnesium silicate was used instead of AMBERLYST® A26 OH. The results are shown in Table 4.

TABLE 4

| | Example 11 | Example 12 |
|---|---|---|
| Reaction Time [h] | 0.5 | 0.5 |
| Temperature [° C.] | 200 | 175 |
| Cl in Feed Oil [ppm] | 12.4 | 12.4 |
| Cl in Treated Oil [ppm] | 0.87 | 2.19 |

Example 13

Treatment of Tallow with Basic Ion Exchange Resin

Example 8 was repeated except that tallow was used instead of used cooking oil. The results are shown in Table 5.

TABLE 5

| | |
|---|---|
| Reaction Time [h] | 0.5 |
| Temperature [° C.] | 200 |
| Cl in Feed Oil [ppm] | 0.45 |
| Cl in Treated Oil [ppm] | 0.26 |

Example 14

Treatment of Corn Oil with Water 40 g of corn oil and 20 g of deionized water were loaded into a 100 mL autoclave reactor. The headspace inside the autoclave reactor was purged with $N_2$ to remove air, and then sealed. The reactor temperature was increased to 200° C. and held at 200° C. for 4 hours. The fluids inside the reactor were stirred at 500 rpm to maintain good mixing. After reaction, the reactor was cooled down to room temperature. The treated oil was separated from the water by centrifugation and the treated oil was analyzed for chloride content. The results are shown in Table 6.

TABLE 6

| | |
|---|---|
| Reaction Time [h] | 0.5 |
| Temperature [° C.] | 200 |
| Cl in Feed Oil [ppm] | 1.55 |
| Cl in Treated Oil [ppm] | 0.52 |

Example 15

Treatment of Corn Oil with NaOH

Example 9 was repeated except that the deionized water was spiked with 100 ppm NaOH. The results are shown in Table 7.

TABLE 7

| | |
|---|---|
| Reaction Time [h] | 0.5 |
| Temperature [° C.] | 200 |
| Cl in Feed Oil [ppm] | 1.55 |
| Cl in Treated Oil [ppm] | 0.21 |

The invention claimed is:

1. A process for removing organic chlorides from a glyceride oil, consisting essentially of:

(a) heating a glyceride oil consisting essentially of organic chlorides and dissolved water at a temperature of at least 80° C. to form a treated glyceride oil, wherein the glyceride oil has a dissolved water content of from 0.05 to 1.0 wt. %;

(b) washing the treated glyceride oil with water, thereby generating an aqueous phase comprising consisting essentially of water and chloride compounds and a non-aqueous phase consisting essentially of the treated glyceride oil, wherein the treated glyceride oil has a reduced concentration of organic chlorides compared to the glyceride oil heated in (a); and (c) separating the non-aqueous phase from the aqueous phase.

2. The process of claim 1, wherein a mass ratio of water to treated glyceride oil is in a range from 1:2 to 100:1.

3. The process of claim 1, wherein the glyceride oil is a pretreated glyceride oil, the pretreated glyceride oil having been subjected to one or more pretreatment processes before the heating, wherein the pretreatment processes are selected from the group consisting of acid washing, base neutralization, filtration, centrifugation, and any combination thereof.

4. The process of claim 1, wherein the glyceride oil is selected from the group consisting of vegetable oils, algae oils, animal fats, and any combination thereof.

5. The process of claim 1, wherein the glyceride oil is selected from the group consisting of yellow grease, brown grease, floatation grease, poultry fat, inedible corn oil, used cooking oil, inedible tallow, floatation tallow, palm sludge oil, and any combination thereof.

6. The process of claim 1, wherein the glyceride oil has an organic chloride content of from 0.01 ppm to 100 ppm, measured as elemental Cl.

7. The process of claim 1, wherein the heating is conducted at a temperature of from 100° C. to 300° C.

* * * * *